US006955245B2

(12) United States Patent
Dünser et al.

(10) Patent No.: US 6,955,245 B2
(45) Date of Patent: Oct. 18, 2005

(54) ELEVATOR INSTALLATION COMPRISING A NUMBER OF INDIVIDUALLY PROPELLED CARS IN AT LEAST THREE ADJACENT HOISTWAYS

(75) Inventors: Thomas Dünser, Rikon (CH); Romeo Deplazes, Oberrüti (CH)

(73) Assignee: Inventio AG, Hergiswil ( * ) Notice: Subject to any disclaimer, the term of this patent is extended or adjusted under 35 U.S.C. 154(b) by 127 days.

(21) Appl. No.: 10/444,626

(22) Filed: May 23, 2003

(65) Prior Publication Data

US 2003/0217893 A1 Nov. 27, 2003

(30) Foreign Application Priority Data

May 27, 2002 (EP) ..... 02405420

(51) Int. Cl.[7] ..... B66B 1/18
(52) U.S. Cl. ..... 187/382; 187/249
(58) Field of Search ..... 187/249, 247, 187/380, 382, 383, 385, 387, 414

(56) References Cited

U.S. PATENT DOCUMENTS

| | | | | |
|---|---|---|---|---|
| 1,939,729 A | * | 12/1933 | Stark | 187/249 |
| 3,658,155 A | | 4/1972 | Salter | |
| 3,750,849 A | * | 8/1973 | Berkovitz | 187/266 |
| 5,090,515 A | * | 2/1992 | Takahashi et al. | 187/249 |
| 5,419,414 A | * | 5/1995 | Sakita | 187/391 |
| 5,655,625 A | * | 8/1997 | Barker et al. | 187/249 |
| 5,752,585 A | * | 5/1998 | Bittar et al. | 187/249 |
| 5,758,748 A | * | 6/1998 | Barker et al. | 187/249 |
| 5,773,772 A | * | 6/1998 | McCarthy et al. | 187/289 |
| 5,816,368 A | * | 10/1998 | Barrett et al. | 187/289 |
| 5,823,299 A | * | 10/1998 | Wierschke et al. | 187/277 |
| 5,865,274 A | * | 2/1999 | Kiji et al. | 187/380 |
| 5,877,462 A | * | 3/1999 | Chenais | 187/249 |
| 5,924,524 A | * | 7/1999 | Barker et al. | 187/249 |

FOREIGN PATENT DOCUMENTS

| | | |
|---|---|---|
| JP | 6048672 | 2/1994 |
| JP | 6080324 | 3/1994 |
| JP | 6080348 | 3/1994 |
| JP | 6080352 | 3/1994 |
| JP | 9077418 | 3/1997 |
| JP | 2000185885 | 7/2000 |

* cited by examiner

*Primary Examiner*—Jonathan Salata
(74) *Attorney, Agent, or Firm*—Butzel Long

(57) ABSTRACT

Elevator cars move in two vertical hoistways each having at least one crossing-point to a third vertical parking hoistway arranged between the two hoistways to allow transfer of the elevator cars between adjacent ones of the hoistways. A control system and a drive move empty elevator cars through the crossing-points for parking and for responding to calls for service.

19 Claims, 5 Drawing Sheets

ELEVATOR INSTALLATION COMPRISING A NUMBER OF INDIVIDUALLY PROPELLED CARS IN AT LEAST THREE ADJACENT HOISTWAYS

BACKGROUND OF THE INVENTION

The present invention relates to an elevator with several self-propelled cars and at least three adjacently situated vertical elevator hoistways, and to a method of operating such an elevator.

The elevator according to the present invention provides several approaches to arranging the elevator hoistways of an elevator installation. Several examples are shown in a diagrammatic plan view in FIGS. 1A–1D.

In FIG. 1A, two vertical elevator hoistways 1 and 2 are shown, which are situated adjacently. In each of the two hoistways 1 and 2, at least one elevator car 3 moves up and down. Each of the hoistways 1 and 2 has a hoistway door 4.

In FIG. 1B a further arrangement is illustrated, which shows two vertical elevator hoistways 5 and 6, which hoistways are situated adjacently. Along the depth of the hoistway, each of the elevator hoistways 5 and 6 has two sections of hoistway situated one behind the other. An elevator car 3, which moves in the front section of one of the hoistways 5 and 6 (as shown in the left hoistway 5), serves the hoistway doors 4. An elevator car 3, which moves in the back section of one of the hoistways 5 and 6 (as shown in the right hoistway 6), does not afford access to any of the hoistway doors 4. There can be several of the elevator cars 3 in circulation.

The Japanese patent application publication number JP 6080324 shows an arrangement with two adjacently situated hoistways, similar to that shown in FIG. 1B. Different than in FIG. 1B, along the depth of the hoistway, each of the elevator hoistways has three sections of hoistway situated one behind the other. Only the front section of the hoistway has access to the hoistway doors, in a manner similar to FIG. 1B. An extension of the concept according to FIG. 1B is seen in the Japanese patent application publication number JP 6080352. Along the depth of the hoistway, the arrangement according to JP 6080352 has several hoistway sections and horizontal or sloping crossing-points. There are hoistway doors both in the front hoistway wall (as in FIG. 1B) and in the back hoistway wall. The elevator cars must therefore have access openings on two opposite sides.

A further arrangement of the elevator according to the present invention is shown in FIG. 1C. This arrangement has one vertical elevator hoistway 7. Left and right in this elevator hoistway 7, the elevator cars 3 can be moved up and down. In a central hoistway section 9, there are no hoistway doors 4. There are two different approaches to transportation which can be realized in such a hoistway 7. Either the central hoistway section 9 is used only for transferring the elevator cars 3 from left to right, or vice versa, or the central section 9 is used for vertical transportation and/or for parking the elevator cars 3.

In the U.S. Pat. No. 3,658,155, an arrangement is described which is comparable with the variant shown in FIG. 1C. According to this U.S. patent specification, the central section between the left hoistway section and the right hoistway section is used for temporarily parking the elevator cars. The elevator cars move along a central transportation arrangement. An elevator car can be disengaged and parked in the central section.

The Japanese patent application publication number JP 09077418 shows an arrangement with three adjacently situated hoistway sections, similar to that shown in FIG. 1C. The left section of the hoistway is used for upward trips, and the right section of the hoistway is used for downward trips. The central section of the hoistway is used for fast downward trips, but has no hoistway doors for boarding or exiting. Behind the three adjacently situated sections of hoistway, in both the headroom and the pit, there is a connecting hoistway for the purpose of transferring the cars between the three vertical sections of hoistway. In the right and left sections of hoistway, the elevator cars are moved together as a group in a vertical direction. In the central section of hoistway, an autonomous vertical movement is possible.

The Japanese patent application publication number JP 2000185885 shows an arrangement with four adjacently situated sections of hoistway, similar to that shown in FIG. 1C. A significant difference is to be seen in that the sections of hoistway are arranged separately, and only connected by sloping crossing-points.

A variant of the arrangement shown in FIG. 1C is outlined in FIG. 1D. The hoistway 7 has three complete sections of hoistway which are situated adjacently. Not only the left and the right sections of hoistway have hoistway doors 4, but the central section of hoistway also has hoistway doors 8.

With regard to the drive of the elevator cars 3, there are two different basic approaches. Either the elevator cars 3 are conveyed together at least in the vertical direction, or the cars can be moved individually. The latter approach results in additional flexibility.

A disadvantage of some of the known hoistway arrangements is that when the elevator cars cross over from one travel path to another, or when they change over from one elevator hoistway to the other elevator hoistway, the elevator cars containing passengers undergo lateral acceleration. Such lateral acceleration is unpleasant for the passengers being transported. Such changeovers are also associated with strong vibrations, which can be experienced as disturbing. These factors can cause passengers to feel insecure, especially since the passenger is in an enclosed car and has no visual contact or reference to the outside.

On the other hand, other arrangements require a relatively large amount of space, without significantly increasing the transportation capacity, or else the constructional cost outlay is large. Some of the known arrangements require stopping places and/or hoistway doors on several side walls of a hoistway. From the constructional standpoint, this is costly. Furthermore, on changing direction, or when changing cars, passengers must under certain circumstances walk around a hoistway to board another elevator car.

SUMMARY OF THE INVENTION

The present invention concerns a method of operating an elevator installation with at least three adjacently situated vertical elevator hoistways and a plurality of individually driven elevator cars movable in the hoistways, the two outwardly situated hoistways having access openings which lie in one vertical plane, and the centrally situated hoistway having crossing-points which allow movement of the elevator cars between adjacent ones of the hoistways, comprising the steps of: a) ready one of the elevator cars in one of the two outwardly situated hoistways in response to a call for an upward trip; b) ready one of the elevator cars in another of the two outwardly situated hoistways in response to a call for a downward trip; c) execute a transfer of an empty one of the elevator cars from one of the two outwardly situated hoistways to the centrally situated hoistway to park the empty elevator car in the centrally situated hoistway; and d) in response to service requirements, ready in the centrally situated elevator hoistway in waiting positions in the vicinity of the crossing-points empty ones of the elevator cars for rapid transfer to one of the outwardly situated hoistways to perform said step a. or said step b.

The present invention also concerns an elevator installation comprising: a plurality of individually driven elevator cars; a first vertical elevator hoistway having access openings in a vertical plane; a second vertical elevator hoistway having access openings in said vertical plane; a vertical parking hoistway situated between said first hoistway and said second hoistway and having crossing-points permitting movement of said elevator cars between said parking hoistway and said first and second hoistways; a driving means on each of said elevator cars for moving said elevator cars vertically in said hoistways and horizontally in said crossing-points; and a control system connected to said driving means and being responsive to calls for service to cause said driving means to move said elevator cars in said first and second hoistways to said access openings corresponding to said calls and being responsive to empty ones of said elevator cars to cause said driving means to move said empty ones of said elevator cars to said parking hoistway.

Given the known arrangements, it is an objective of the present invention to provide an elevator system and a corresponding method which reduce the disadvantages of the state of the art, or avoid them completely.

A particular objective is to provide an elevator system and a corresponding method by means of which the passengers being transported are not subjected to any disturbing influences.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1A:
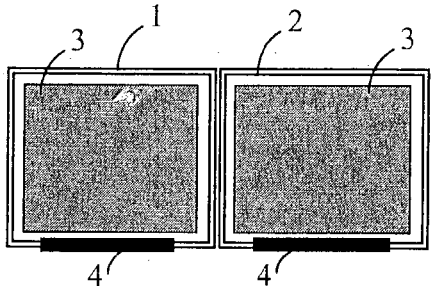
FIGS. 1A–1D are schematic plan views of various known elevator systems.
Figure 1B:
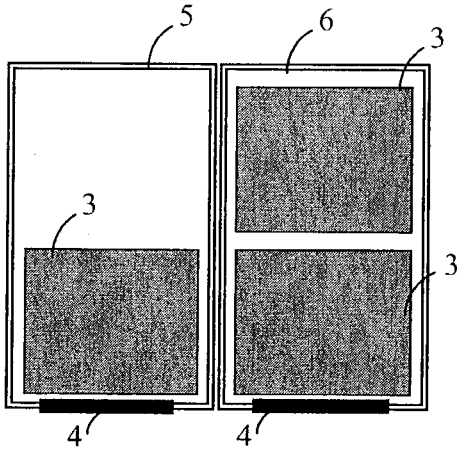
Figure 1C:
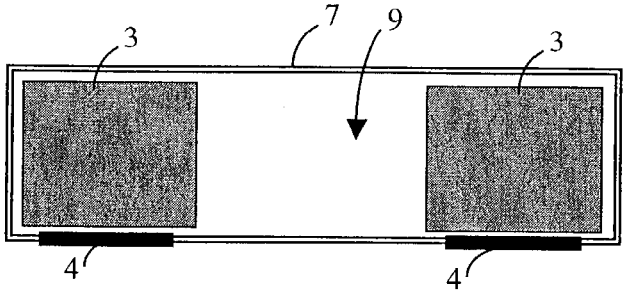
Figure 1D:
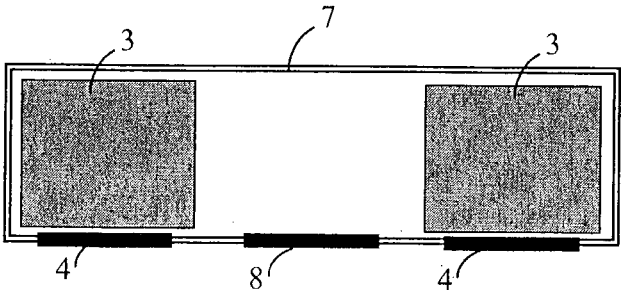
Figure 2:
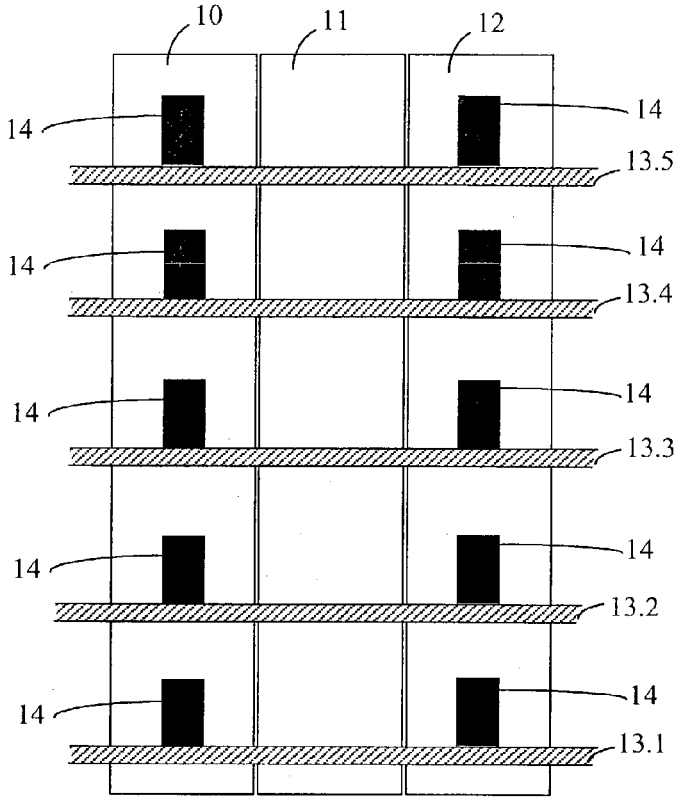
FIG. 2 is a schematic front elevation view of a first elevator system according to the present invention.
Figure 3:
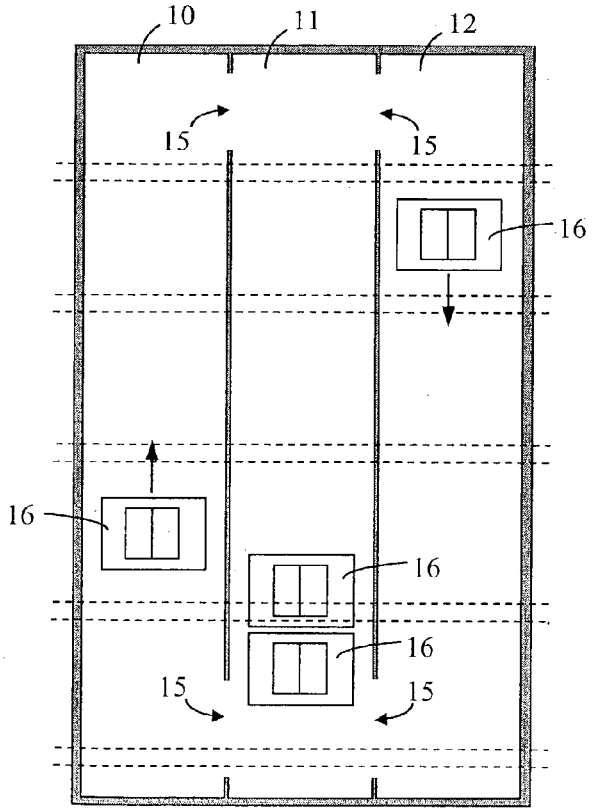
FIG. 3 is a schematic cross-sectional front view of the first elevator system shown in FIG. 1.

A first embodiment of the present invention is described below by reference to FIGS. 2 and 3. An elevator installation is shown which has three adjacently situated vertical elevator hoistways 10, 11 and 12. A total of five floors 13.1–13.5 are served. Within the elevator hoistways 10, 11 and 12, there are several individually driven elevator cars 16 (see FIG. 3). The two outwardly situated elevator hoistways 10 and 12 have access openings 14, which openings all lie in one plane defined by the plane of the drawing. The access openings 14 are usually provided with hoistway doors. The centrally situated elevator hoistway 11 serves as a vertical parking hoistway and has crossing-points 15 (e.g. in the form of passages) which allow movement of the elevator cars 16 between two adjacently situated elevator hoistways. One of the elevator cars 16 can, for example, be moved through one of the passages 15 from the elevator hoistway 10 or from the elevator hoistway 12 into the parking hoistway 11. The elevator cars 16 can also be moved from the parking hoistway 11 into one of the two outward elevator hoistways 10 and 12.

According to the present invention, the elevator cars 16 are first readied in a first of the two outwardly situated elevator hoistways (for example, in the elevator hoistway 10), if a call command for an upward trip arrives at the elevator control. If a call command for a downward trip arrives, one of the elevator cars 16 in the second of the two outwardly situated elevator hoistways (for example, in the elevator hoistway 12) can be readied. The installation is so designed that a crossover of an empty elevator car 16 from one of the two outwardly situated elevator hoistways 10 and 12 into the centrally situated parking hoistway 11 only takes place if the elevator car 16 is empty. Empty elevator cars 16 are parked in the parking hoistway 11. The elevator control is preferably so designed that readying of empty elevator cars 16 takes place depending on requirements. For this purpose, empty elevator cars 16 are parked in waiting positions in the parking hoistway 11 in the vicinity of the crossing-points 15, to allow rapid readying in case of a call command.

For the elevator installation a rectangular plan was selected, since this arrangement of the three elevator hoistways 10, 11 and 12 ensures a good transportation performance with acceptable space utilization.

Figure 4:
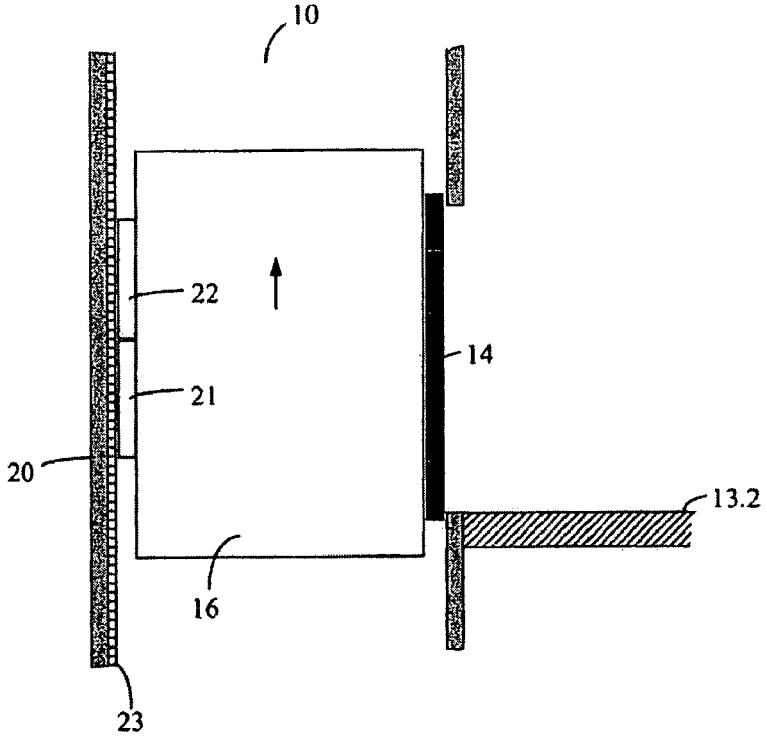
FIG. 4 is a schematic cross-sectional side view of a section of the first elevator system shown in FIG. 3.

According to another embodiment of the present invention, each of the elevator cars 16 has an autonomous car-mounted linear drive 21 and 22 which enables the elevator cars 16 to move independently in a vertical direction in the vertical elevator hoistways 10, 11 and 12. Such a system is illustrated in FIG. 4, which shows a section through the elevator hoistway 10. Arranged on a rear wall 20 of the hoistway is a non-electrified driving component 23 (e.g. the secondary component of a linear-motor drive) along which the linear drive 21 and 22 moves. The linear drive 21 and 22 has a control which enables it so to control the linear drive 21 and 22 that the latter causes an upward trip or a downward trip of the elevator car 16 in the respective elevator hoistway. Control of the linear drive 21 and 22 takes place by reference to a call command which can be initiated, for example, by pressing a call button.

In a further embodiment, an elevator car 16 has an additional drive for the purpose of moving the elevator car 16 independently in a horizontal direction from one of the elevator hoistways 10 and 12 into the parking hoistway 11, or out of the parking hoistway 11.

Alternatively, the linear drive 21 and 22 which is present and used to move the elevator cars 16 vertically can be swiveled in such manner that this linear drive 21 and 22 can also be used to cause the horizontal movement between adjacent elevator hoistways. This swiveling preferably takes place together with a swiveling of a section of the non-electrified drive component 23, since swiveling of the linear drive 21 and 22 alone would necessitate detachment of the linear drive 21 and 22 from the non-electrified drive component 23. Such detachment is laborious, because between the linear drive 21 and 22 and the non-electrified drive component 23 enormous attraction forces prevail.

Figure 5:
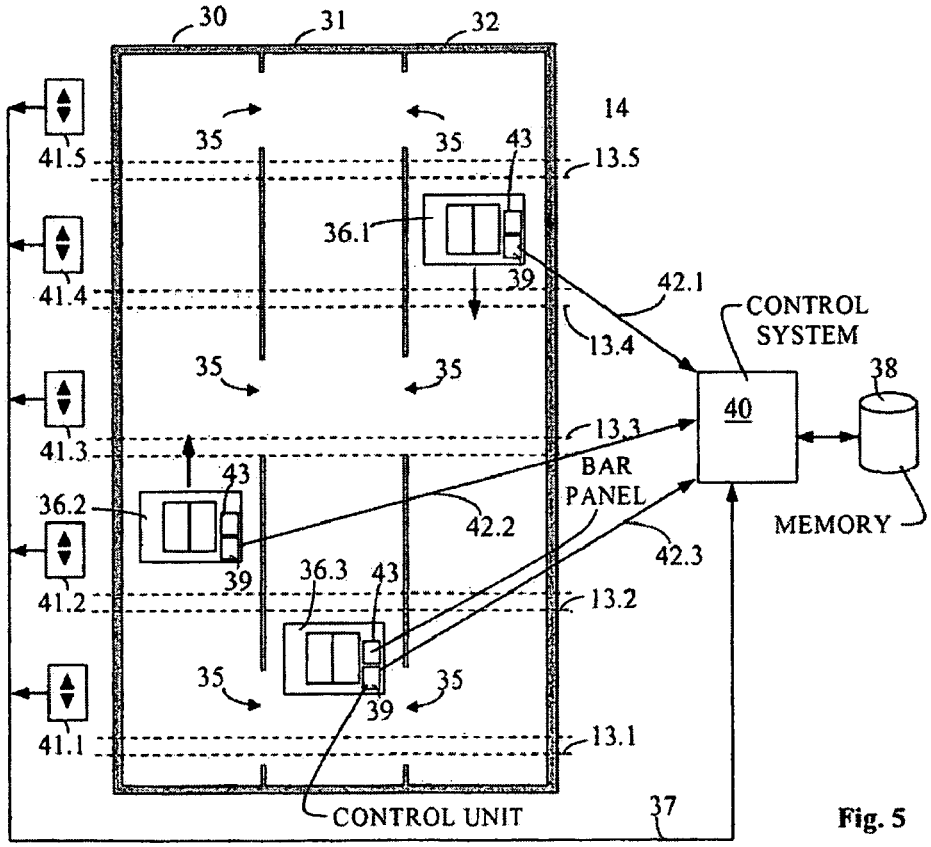
FIG. 5 a schematic cross-sectional front view of a second elevator system according to the present invention.

According to a further embodiment of the present invention, the elevator system has a control system 40, as shown diagrammatically in FIG. 5. The control system 40 is so designed that use is made of a so-called requirements profile to enable empty elevator cars 36.1–36.3 to be readied according to needs. Such a requirements profile can have a fixed specification, or it can adapt itself dynamically. The requirements profile is preferably stored in a memory 38 connected to the control 40. Especially suitable is a requirements profile in which certain basic requirement patterns are specified, but which automatically develop further through daily observation of the elevator operation.

This operation is explained by a simple example. In the case of an elevator system in an office building, when work starts there are many upward trips to the various offices. According to the present invention, the requirements profile is so designed that the several empty elevator cars 36.1–36.3 are parked in the lower sector of a parking hoistway 31, so that sufficient empty elevator cars 36.1–36.3 stand ready for the forthcoming upward trips. In the evenings, or when work ends, several empty elevator cars 36.1–36.3 are required in the upper and middle sectors of the hoistway, since many passengers leave their offices and travel in the direction of the ground floor 13.2 or the parking basement 13.1. By automatically adapting the control system 40 can, for example, take into account that there may be differences in passenger behavior between summer and winter. It is also conceivable that during absences for vacations the requirements profile adapts itself by recording how many upward trips are requested in the morning, and then in the evening of the same day, possibly readying fewer elevator cars 36.1–36.3 than usual.

The elevator system according to the embodiment shown in FIG. 5 has three adjacently situated elevator hoistways 30, 31 and 32, of which the central hoistway serves as a vertical parking hoistway 31. In the example shown, in the vicinity of the bottom floor 13.1 (parking basement), in the vicinity of the floor 13.3, and on the top floor 13.5 there are passages 35, which allow transfer of the elevator cars 36.1–36.3 between two adjacently situated elevator hoistways 30, 31 and 32. In the example shown, the control system 40 includes the memory 38 which, for example, readies requirements profiles. On each of the floors 13.1–13.5 there is an associated one of a like number of panels 41.1–41.5 by means of which, in case of need, one of the elevator cars 36.1–36.3 can be called. In the embodiment shown, the panels 41.1–41.5 are connected via a communication connection 37 to the control system 40. Each of the elevator cars 36.1–36.3 has a car panel 43 and a control unit 39, which can be connected via communication connections 42.1–42.3 to the central control system 40 of the elevator installation. The components 37, 38, 39, 40, 41.1–41.5, 42.1–42.3, and 43 collectively are designated as the elevator control. In FIG. 5, the communication connections 37 and 42.1–42.3 are shown only diagrammatically. The communication connections 37 and 42.1–42.3 are usually bus connections or parallel wired connections.

Following initiation of a call command by, for example, actuation of the "up" button on the panel 41.1, this call command is transmitted via the communication connections 37 to the control system 40. The control system 40 selects the elevator car 36.3 which is close to the floor 13.1 and empty. Via the communication connection 42.3, the control system 40 commands the control unit 39 of the elevator car 36.3. This can take place, for example, by the control system 40 passing to the control unit 39 of the elevator car 36.3 a requirements profile, which is then automatically executed by the control unit 39. In this case, the control unit 39 must be of an intelligent form to be capable of independently executing a requirements profile. In another embodiment, the control units 39 are subordinated to the control system 40, and therefore need not be designed so elaborately.

The control unit 39 activates and controls the autonomous linear drive of the elevator car 36.3 in such manner that the latter moves from the parking hoistway 31, in which according to FIG. 5 it is present, through the passage 35 into the left elevator hoistway 30 which is reserved for upward trips. The elevator car 36.3 then halts independently at the floor 13.1, from which the call command was issued, where it opens the car doors (if present) and hoistway doors. After the passenger has boarded the elevator car 36.3 and pressed a floor button on the car panel 43 in the car, the doors close and the elevator car 36.3 is set in motion. At the desired destination floor, the elevator car 36.3 halts, to allow the passenger to exit. The elevator car 36.3 then moves through the nearest passage 35 back into the parking hoistway 31, if the control system 40 has transmitted to the control unit 39 of the elevator car 36.3 a corresponding requirements profile. Otherwise, the elevator car 36.3 can, for example, remain in the elevator hoistway 30 until a new requirements profile is passed to the control unit 39 by the control system 40.

It is self-evident that there are various variants of the elevator control which can be realized in such an elevator system. It is preferable for the control system 40 to retain a certain authority over the control units 39 of the elevator cars 36.1–36.3. This is advantageous for the following reasons:

- avoidance of collisions of the elevator cars 36.1–36.3;
- readying of the elevator cars 36.1–36.3 in the elevator hoistways 30 and 32 according to requirements;
- readying of the elevator cars 36.1–36.3 in the parking hoistway 31 according to requirements;
- reversal of direction in the elevator hoistways 30, 31 and 32;
- special traffic for maintenance, or in case of other faults, etc.

According to a further embodiment of the present invention, the elevator system is so designed that before execution of a transfer of an elevator car from one of the hoistways into another hoistway, the respective elevator car is checked for the absence of passengers. For this purpose, sensors can be fitted in or on the elevator car. Only then does the elevator stop at one of the passages, and only then is the change of hoistway initiated and executed.

Figure 6A:
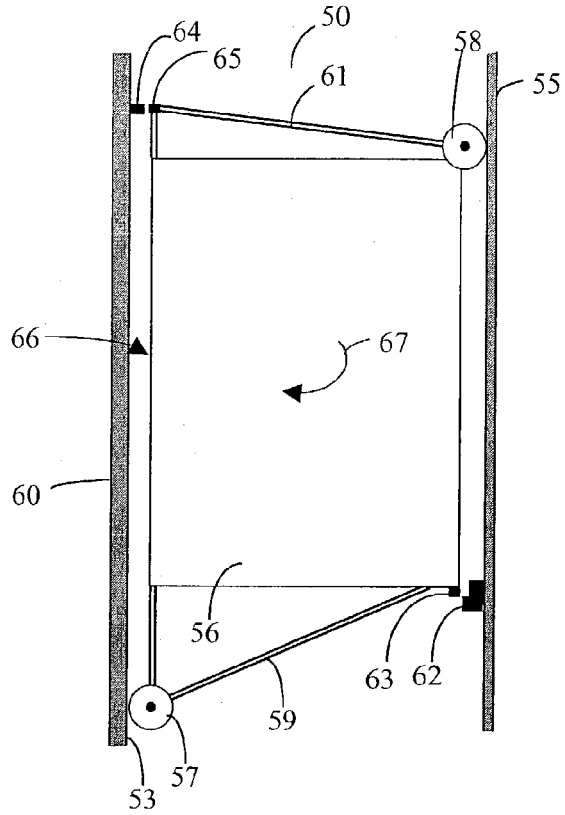
FIGS. 6A–6B are schematic cross-section side view of a section of a third elevator system according to the present invention.
Figure 6B:
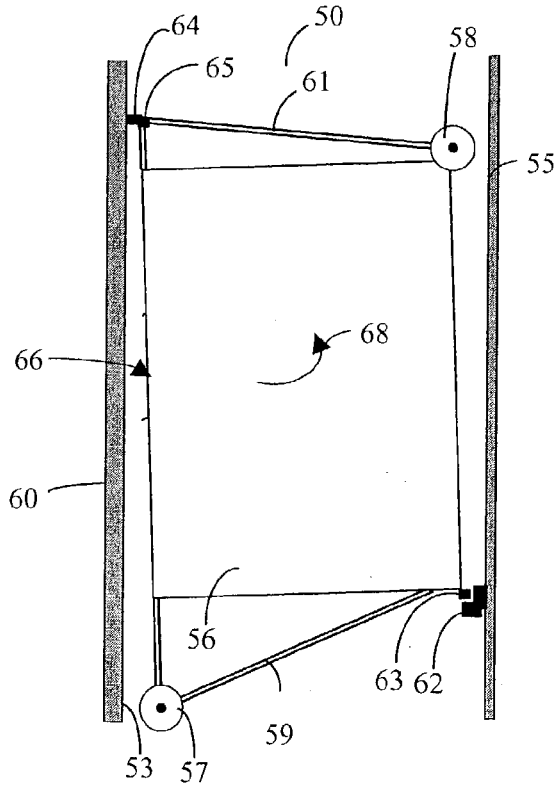

A further embodiment according to the invention is shown in a side view in FIGS. 6A and 6B. Supported by the elevator car 56 on a lower suspension 59 is a lower pair of rollers 57 (of which only one wheel is visible). Diagonally opposite on an upper edge of the elevator car 56, a further pair of rollers 58 is supported (of which only one wheel is visible). These pairs of rollers 57 and 58 guide the elevator car 56 along guide rails 53 and 55 respectively. For this purpose, the pairs of rollers 57 and 58 may possibly be provided with flanges so that guidance in the direction of movement is assured. It is preferable for the car-mounted drive (not shown in FIGS. 6A and 6B) to be arranged on an outside back wall 66 of the elevator car 56. This eccentric arrangement of the drive on the back 66 of the car 56 gives rise to a torque (as shown in FIG. 6A by an arrow 67), so that for positioning of the elevator car 56 only the two pairs of rollers 57 and 58 are needed. This torque acts clockwise, and is of such magnitude in every travel situation that the rollers of the roller pairs 57 and 58 are under pressure. The torque results from the force of the car-mounted drive and the force of gravity.

When executing a crossover of the elevator car 56 from one elevator hoistway 50 into an adjacent hoistway, the following steps are executed once the elevator car 56 is empty and has been halted at a prescribed position in the elevator hoistway 50. This situation is shown in FIG. 6A. So as to be able to move the elevator car 56 into the adjacent hoistway, the elevator car 56 is brought into contact with horizontal guiding elements 62 and 64. For this purpose, engaging elements 63 and 65 are provided on the elevator car 56. The horizontal guiding elements 62 and 64 are located in the vicinity of a passage. The engaging element 63 in FIG. 6A is pushed out beyond the lower edge of the car and the elevator car 56 slightly lowered, so that the latter supports itself on the guiding element 62 by means of the engaging element 63.

The supporting force, and the weight of the elevator car 56, result in a torque which tilts the elevator car 56 counterclockwise about a pivot point situated at the elements 62 and 63 (as indicated in FIG. 6B by an arrow 68) until it rests with its engaging element 65 against the guiding element 64. As a result of this tilting motion, the guiding rollers 57 and 58 become disengaged from (out of contact with) the guide rails 53 and 55, and the elevator car 56 can be moved horizontally.

This tilting movement is preferably initiated by cessation of the torque (arrow 67) which originates from the drive. If the drive is switched off, this torque ceases, and the elevator car 56 tilts counterclockwise under its own weight as shown in FIG. 6B. The tilting motion can, however, also be produced or assisted by mechanical or electromechanical means.

Return of the elevator car 56 to the vertical after a horizontal movement can be achieved by generating an upward force in the car-mounted drive.

By the slight tilting of the elevator car 56, the rollers of the lower pair of rollers 57 are moved to the right away from the guide rail 53. At the same time, the upper pair of rollers 58 moves to the left away from the guide rail 55. In other words, tilting causes both pairs of rollers 57 and 58 of the elevator car 56 to be disengaged from the guide rails 53 and 55 fastened to the hoistway. While tilting, the engaging element 63 makes contact with the horizontal guiding element 62 in the form of a long angle iron. In the specific example, the engaging element 63 rests on a horizontal leg of the guiding element 62. The engaging element 65 which is fastened diagonally opposite makes contact with the guiding element 64 through being pressed against this element 64.

When tilting has finished, the pairs of rollers 57 and 58 no longer have a guiding function. The elevator car 56 can now be moved along the guiding elements 62 and 64 perpendicular to the longitudinal direction of the elevator hoistway 50 (i.e. into the plane of the drawing, or out of this plane).

The embodiment shown in FIGS. 6A and 6B offers various advantages. A car-mounted drive usually presents the problem that the driving force acts outside the center of gravity of the car. This can cause the elevator car to tilt, thereby resulting in jerky movements during travel. The embodiment proposed here transforms this disadvantage into an advantage by the torque from the drive being used during travel to press the pairs of rollers 57 and 58 against the guide rails 53 and 55. As soon as the guiding forces are no longer needed, these forces can be removed by the drive being switched off. This allows slight disengagement of the pairs of rollers 57 and 58 from the guide rails 53 and 55. Because of the type of guidance selected, vertical travel is very comfortable despite the eccentric drive. According to the present invention, guidance of the elevator car 56, and crossover from hoistway to hoistway, use relatively few moving parts. The solution is therefore robust and inexpensive.

Movement of the elevator car 56 along the guiding elements 62 and 64 can be effected by the elevator car 56 itself, with the movement being provided by a drive of the car, or the movement can be effected by motive means which are located in the elevator hoistway in the vicinity of the passage.

In a further embodiment, contact between elements on the elevator car and guiding elements in the elevator hoistway can be effected by mechanical or electro-mechanical means. In this case, no tilting motion of the elevator car need be executed, since both disengagement of the pairs of rollers from the guide rails, and the creation of contact, can be effected by the mechanical or electromechanical means.

A further embodiment is characterized in that before the car drive is switched off, a slide or similar means (e.g. the engaging element 63) on the elevator car 56 can be extended to make contact with an opposite means (e.g. the guiding element 62) in the hoistway. This means can be implemented in such manner as to prevent sinking of the elevator car 56, and/or to serve as the pivot point for execution of the tilting motion.

Figure 7:
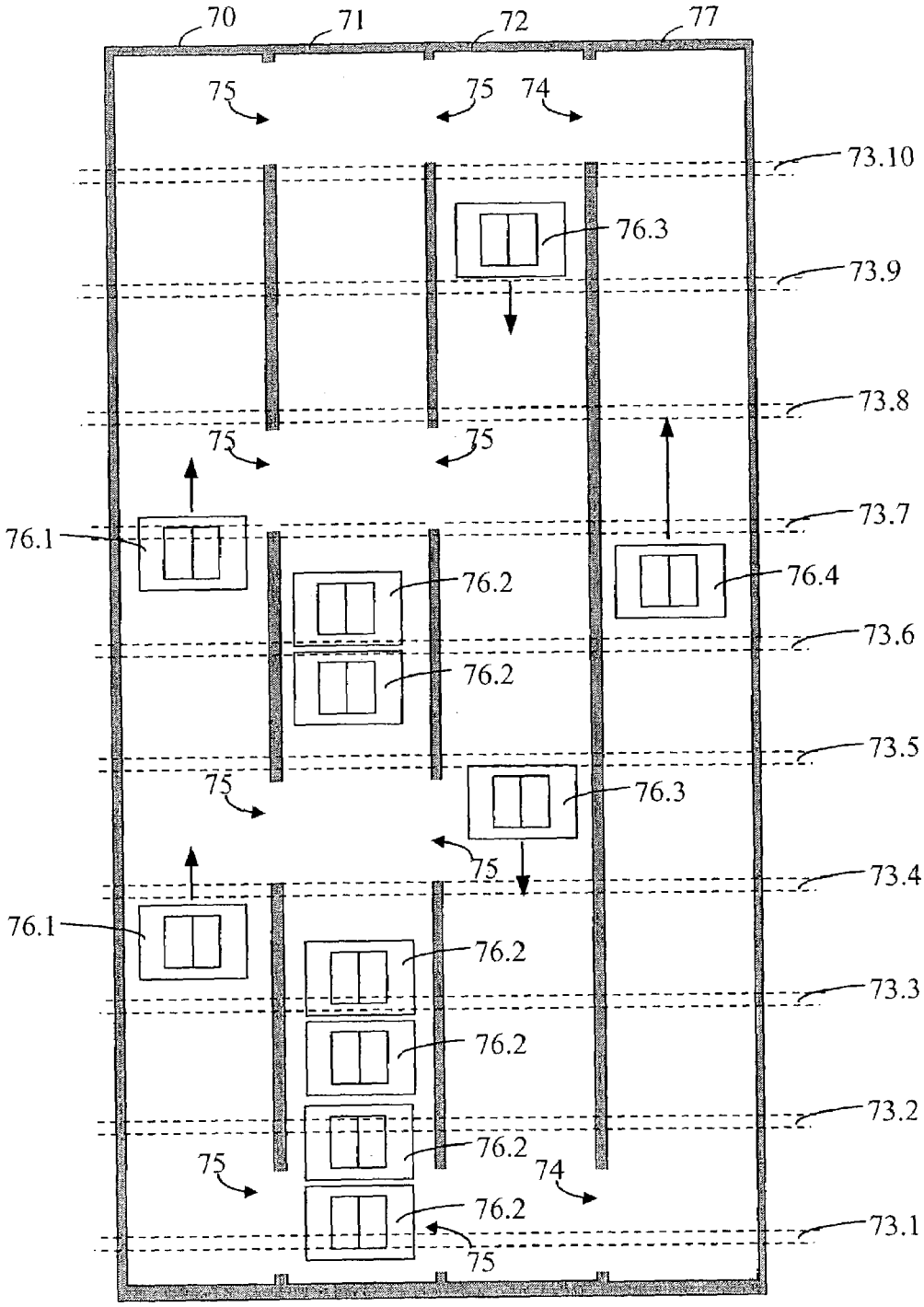
FIG. 7 is a schematic cross-sectional front view of a fourth elevator system according to the present invention.

In a further embodiment, which is represented schematically in FIG. 7, there are at least four elevator hoistways 70–72 and 77, of which at least the elevator hoistway 77 is reserved for long trips. Preferably, there is one elevator hoistway for long trips in an upward direction (e.g. the elevator hoistway 77) and one elevator hoistway for long trips in a downward direction. These elevator hoistways (e.g. the elevator hoistway 77) can serve as an overtaking route. Delays on long trips can thereby be largely avoided.

The number of crossing-points 74 to the long-trip hoistway 77 can be less than the number of crossing-points 75 between the elevator hoistways 70 and 72 and the parking hoistway 71, since in the long-trip hoistways 77, as the name already implies, preferably only long trips are made. Changing from the elevator hoistway 77 for long trips, into another elevator hoistway 72, only takes place after a long trip is completed, for example at a top floor 73.10 or at a bottom floor 73.1. An advantage of the arrangement with long-trip hoistways is that time-consuming long trips are not delayed by an elevator car 76.2 waiting on the first floor 73.1. Short trips are preferably made in the two elevator hoistways 70 and 72, between which the vertical parking hoistway 71 is situated. With this arrangement, the elevator cars 76.1 and 76.3 can cross over into the parking hoistway 71 as soon as a trip is completed.

In the example shown, two elevator cars 76.1 are traveling upward in the elevator hoistway 70, and two elevator cars 76.3 are traveling downward in the elevator hoistway 72. There are six elevator cars 76.2 in the parking hoistway 71. One elevator car 76.4 is moving upward at high speed on a long trip in the elevator hoistway 77.

Instead of an autonomous car-mounted linear drive, the elevator cars can be provided with a friction-wheel drive, gearwheel drive, rack drive, or similar.

The arrangement according to the invention is particularly advantageous because it depends on a combination of two important parameters. The parameters particularly support each other in the claimed arrangement. Firstly, the vertical parking hoistway affords the advantage that elevator cars that are not in use can be withdrawn from traffic in the hoistway. The vertical embodiment and arrangement of the parking area as a central hoistway requires little space.

Further, the crossing-points between the elevator hoistways and the parking hoistway can be arranged so that each floor can be traveled to within a specified time. Moreover, the elevator cars can be distributed and readied away from the passenger traffic.

The vertical parking hoistway affords the advantage that additional elevator cars can be stored in the elevator system and called into use when required. Also, according to the invention, one-way operation can be continued indefinitely, since elevator cars can be repeatedly made ready from the parking hoistway. Empty elevator cars preferably remain in the vertical elevator hoistways for only as long as absolutely necessary.

The arrangement according to the invention affords a high degree of comfort for the passengers, since vibrations are avoided, and passengers are not subjected to lateral acceleration.

According to the present invention, all hoistway doors are arranged in one vertical plane. By this means, travel of the elevator cars in direction normal to said plane is avoided.

Lateral acceleration of loaded elevator cars is also avoided by the elevator cars only executing changes of hoistway in the empty (unloaded) state.

According to the present invention, the direction of travel can be defined for each hoistway. Preferably, one of the hoistways is used exclusively for upward trips, and another hoistway for downward trips.

According to the present invention, an arrangement and a method are provided which allow good transportation performance with reasonable constructional outlay. The elevator of the present invention affords great flexibility since, in case of need, empty elevator cars can be made ready at several different places.

The greater the number of crossing-points provided between adjacent elevator hoistways, the more flexibly the traffic concept of the elevator installation can be designed.

According to the present invention, one of the elevator hoistways (preferably the central hoistway) serves as a lay-by and parking hoistway. This elevator hoistway need not have any access openings.

Use of a parking hoistway has the advantage that at any time, only the number of elevator cars required at that time need be kept in circulation. This has, for example, an influence on the overall energy balance of an elevator installation. Furthermore, wear is reduced through the elevator cars not being in continuous use.

There are advantages of the invention in that the cross-section of the elevator hoistway is substantially reduced relative to that of a conventional hoistway arrangement for the same traffic capacity. Waiting times in front of the elevator hoistways, and time spent in the elevator cars, are made shorter by the invention. Building construction costs can be reduced by comparison to traditional approaches.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method of operating an elevator installation with at least three adjacently situated vertical elevator hoistways and a plurality of individually driven elevator cars movable in the hoistways, the two outwardly situated hoistways having access openings which lie in one vertical plane, and the centrally situated hoistway having crossing-points which allow movement of the elevator cars between adjacent ones of the hoistways, comprising the steps of:

a. ready one of the elevator cars in one of the two outwardly situated hoistways in response to a call for an upward trip;

b. ready one of the elevator cars in another of the two outwardly situated hoistways in response to a call for a downward trip;

c. execute a transfer of an empty one of the elevator cars from one of the two outwardly situated hoistways to the centrally situated hoistway to park the empty elevator car in the centrally situated hoistway; and d. in response to service requirements, ready in the centrally situated elevator hoistway in waiting positions in the vicinity of the crossing-points empty ones of the elevator cars for rapid transfer to one of the outwardly situated hoistways to perform said step a. or said step b.

2. The method according to claim 1 wherein each of the elevator cars has an autonomous car-mounted drive that enables the elevator cars to move independently in a vertical direction in the hoistways, and including operating the drive of a selected one of the elevator cars to cause an upward trip or a downward trip of the selected elevator car in response to a corresponding call.

3. The method according to claim 2 including operating the drives to move the elevator cars independently in a horizontal direction between two adjacently situated ones of the hoistways.

4. The method according to claim 3 wherein the drives are linear drives, and including swiveling the drive of a selected one of the elevator cars before changing between vertical and horizontal movement of the selected one elevator car.

5. The method according to claim 2 wherein each of the elevator cars includes a further drive to move the elevator cars independently in a horizontal direction between two adjacently situated ones of the hoistways.

6. The method according to claim 1 including prior to executing said steps a., b. and d., referring to a stored service requirements profile to ready empty elevator cars depending on the service requirements.

7. The method according to claim 1 including prior to performing said step c., halting one of the elevator cars at the height of a passage forming one of the crossing-points and checking whether the one elevator car is empty.

8. The method according to claim 1 including prior to performing said step c., creating a contact between engaging elements on one of the elevator cars and horizontal guiding elements present in the vicinity of a passage forming one of the crossing-points, tilting the one elevator car to disengage rollers of the elevator car from guide rails fastened to the one of the hoistways in which the one elevator car is situated.

9. The method according to claim 1 wherein each of the elevator cars has an autonomous car-mounted drive that enables the elevator cars to move independently in a vertical direction in the hoistways and a control unit connected via a communication connection to a control system of the elevator installation, and including upon receipt by control system of a call, selecting one of the elevator cars and performing a corresponding one of said step a. and and said step b., transmitting control information from the control system via the communication connection to the control unit of the one elevator car, operating the control unit to command the drive (21, 22) of the one elevator car to move the one elevator car to the access opening of the floor corresponding to the call.

10. The method according to claim 9 including operating the control system to execute software-controlled steps to control and ready the elevator cars depending on traffic in the hoistways.

11. An elevator installation comprising:

a plurality of individually driven elevator cars;

a first vertical elevator hoistway having access openings in a vertical plane;

a second vertical elevator hoistway having access openings in said vertical plane;

a vertical parking hoistway situated between said first hoistway and said second hoistway and having crossing-points permitting movement of said elevator cars between said parking hoistway and said first and second hoistways;

a driving means on each of said elevator cars for moving said elevator cars vertically in said hoistways and horizontally in said crossing-points; and a control system connected to said driving means and being responsive to calls for service to cause said driving means to move said elevator cars in said first and second hoistways to said access openings corresponding to said calls and being responsive to empty ones of said elevator cars to cause said driving means to move said empty ones of said elevator cars to said parking hoistway.

12. The elevator installation according to claim 11 wherein said driving means is an autonomous car-mounted drive that enables said elevator cars to move independently in a vertical direction in said first and second hoistways and in said parking hoistway.

13. The elevator installation according to claim 12 wherein each said autonomous car-mounted drive is a linear drive.

14. The elevator installation according to claim 13 wherein each of said elevator cars has a further drive to move said elevator cars independently in a horizontal direction between two adjacently situated ones of said hoistways.

15. The elevator installation according to claim 13 wherein each said elevator car includes means for swiveling said linear drive to move said elevator car horizontally.

16. The elevator installation according to claim 11 wherein each said elevator car includes means for creating a contact between engaging elements on said elevator car and horizontal guiding elements located in a vicinity of passages forming said crossing-points.

17. The elevator installation according to claim 11 wherein each said elevator car includes means for tilting said elevator car to disengage rollers on said elevator car from guide rails fastened to said hoistways.

18. The elevator installation according to claim 11 including a vertical long-trip hoistway being connected one of said first and second hoistways by additional crossing-points.

19. A method of operating an elevator installation with at least three adjacently situated vertical elevator hoistways and a plurality of individually driven elevator cars movable in the hoistways, outwardly situated ones of the adjacent hoistways having hoistway access openings which lie in one vertical plane, and a centrally situated one of the adjacent hoistways having crossing-points which allow movement of the elevator cars between the centrally situated one and the outwardly situated ones of the adjacent hoistways, comprising the steps of:

a. controlling the elevator cars to move in one of the two outwardly situated hoistways in response only to calls for upward trips;

b. controlling the elevator cars to move in another of the two outwardly situated hoistways in response only to calls for downward trips;

c. transferring empty ones of the elevator cars from one of the two outwardly situated hoistways to the centrally situated hoistway to park and preventing ones of the elevator cars responding to calls from entering the centrally situated hoistway; and d. in response to service requirements, ready in the centrally situated elevator hoistway in waiting positions in the vicinity of the crossing-points empty ones of the elevator cars for rapid transfer to the outwardly situated hoistways to perform said step a. and said step b.

* * * * *